US007828578B1

(12) United States Patent
Ju

(10) Patent No.: US 7,828,578 B1
(45) Date of Patent: Nov. 9, 2010

(54) ELECTRICAL CONNECTOR TERMINAL HAVING TWO CONTACT PORTIONS AND TWO LEANING PORTIONS EXTENDING FROM A BASE

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/585,262

(22) Filed: Sep. 10, 2009

(51) Int. Cl.
*H01R 11/22* (2006.01)

(52) U.S. Cl. ..... 439/342

(58) Field of Classification Search ..... 439/342, 439/856, 857, 83, 884, 891
See application file for complete search history.

(56) References Cited

U.S. PATENT DOCUMENTS 4,743,208 A * 5/1988 Weisenburger ..... 439/398
6,450,844 B1 * 9/2002 Mizumura et al. ..... 439/884
7,303,421 B2 * 12/2007 Liao ..... 439/342
7,335,046 B2 * 2/2008 Ju ..... 439/331
2006/0094297 A1 * 5/2006 Wang ..... 439/578

* cited by examiner

*Primary Examiner*—Chandrika Prasad
(74) *Attorney, Agent, or Firm*—Rosenberg Klein & Lee

(57) ABSTRACT

An electrical connector and a terminal thereof are disclosed. The base portion of the terminal extends upwards to form two flexible arms. Each of the two flexible arms extends towards each other to form a leaning portion. There is a gap between the two leaning portions. Two arm portions extend from two sides of the base portions. The two arm portions respectively have a contact portion. The two contact portions and the two leaning portions are disposed at a front location and a rear location. The two leaning portions and the two contact portions surround to form a receiving space. The present invention can prevent the pins of the chip module from being deformed, improve the usage life of the terminals, and assure that the chip module is electrically connected with the electrical connector.

18 Claims, 6 Drawing Sheets

ELECTRICAL CONNECTOR TERMINAL HAVING TWO CONTACT PORTIONS AND TWO LEANING PORTIONS EXTENDING FROM A BASE

BACKGROUND OF THE INVENTION

1. Field of the Invention

The present invention relates to an electrical connector and a terminal thereof, particularly relates to an electrical connector and a terminal thereof used for connecting the pins of an inserted chip module.

2. Description of Related Art

Electrical connectors are used for electrically connecting a chip module having a plurality of pins. The electrical connector includes a main body and a plurality of terminals received in the main body.

The main body has an upper surface, a lower surface opposite to the upper surface, and a plurality of receiving holes that pass through the upper surface and the lower surface.

The terminals are respectively received in the receiving holes. Each of the terminals has a base portion positioned in the receiving hole. Two sides of the base portion extend upwards and forwards to form two arm portions. The two arm portions are located in the receiving holes, and the two arm portions are symmetrically disposed. Each of the arm portions has a contact portion. The two contact portions respectively and symmetrically extend to form a guiding portion that is away from the base portion. The two guiding portions extend departing from each other. The two guiding portions form a guiding space therebetween for easily plugging the pins. The base portion vertically extends upwards to form two blocking posts. The blocking posts are located in the receiving holes. The two blocking posts are used for pushing and contacting the pins and are symmetrically disposed. The two contact portions and the two blocking posts are disposed at a front location and a rear location. The two leaning portions and the two contact portions surround to form a claming space for clamping the pins.

While assembling, firstly, the terminals are respectively installed in the receiving holes from the lower surface to the upper surface so that the base portion is positioned in the receiving hole and is close to the lower surface. The two arm portions and the two blocking posts are located in the receiving hole. Next, the chip module is installed in the electrical connector. The pin enters into the guiding space and is guided to move towards the two contact portions via the two guiding portions until being pushed into the clamping space. Thereby, the pin contacts the two contact portions and pushes the two blocking posts. The two contact portions and the two blocking posts clamp and contact the pin together.

The drawbacks of the electrical connector are:

1. Because the pin directly contacts the two blocking posts and the two blocking posts extend vertically and upwards from the base portion, part of the two blocking posts that do not contact the pin will perform as two force arms that will provide elastic deformation. However, the pin contacts most part of the two blocking posts, the two force arms are short. Therefore, the flexible force of the two force arms is little and the deformation of the two force arms is little. The recover force of the two blocking posts is small and the pin will be deformed. The deformed blocking posts will not be recovered. The usage life of the terminal is affected.

2. When the pin of the chip module is fully plugged into the main body, end of the pin will be close to the base portion. The stress generated from the pin to the two blocking posts also is close to the base portion. The movement distance of the pin pushing the two blocking posts is too small. Furthermore, there may be tolerance between the chip module and the electrical connector. The pins may not contact some of the terminals. The pins will not electrically connect the terminals normally, as a result, it will affect the electrical connection between the chip module and the electrical connector.

There is a need to provide a novel electrical connector to solve the above problems.

SUMMARY OF THE INVENTION

One object of the present invention is to provide a terminal with improved flexibility and large movement distance and an electrical connector using the same.

The main characteristic of the electrical connector and the terminal thereof is that the base portion of the terminal extends upwards to form two flexible arms. Each of the two flexible arms extends towards each other to form a leaning portion. There is a gap between the two leaning portions. The arm portions extend from both sides of the base portions. The two arm portions respectively have a contact portion. The two contact portions and the two leaning portions are disposed at a front location and a rear location. The two leaning portions and the two contact portions surround to form a receiving space.

Compared with the prior art, the two flexible arms of the terminal respectively have a leaning portion that faces to each other to contact the pin of the chip module. The force arm providing elastic deformation becomes longer. Therefore, the flexibility of the force arm is increased. The pin of the chip module being deformed is avoided and the usage life of the terminal of the electrical connector is improved. Moreover, the movement distance of the force arm also becomes larger so as to guarantee normal electrical connection between the chip module and the electrical connector.

For further understanding of the present invention, reference is made to the following detailed description illustrating the embodiments and drawings of the present invention.

DETAILED DESCRIPTION OF THE PREFERRED EMBODIMENTS

Figure 1:
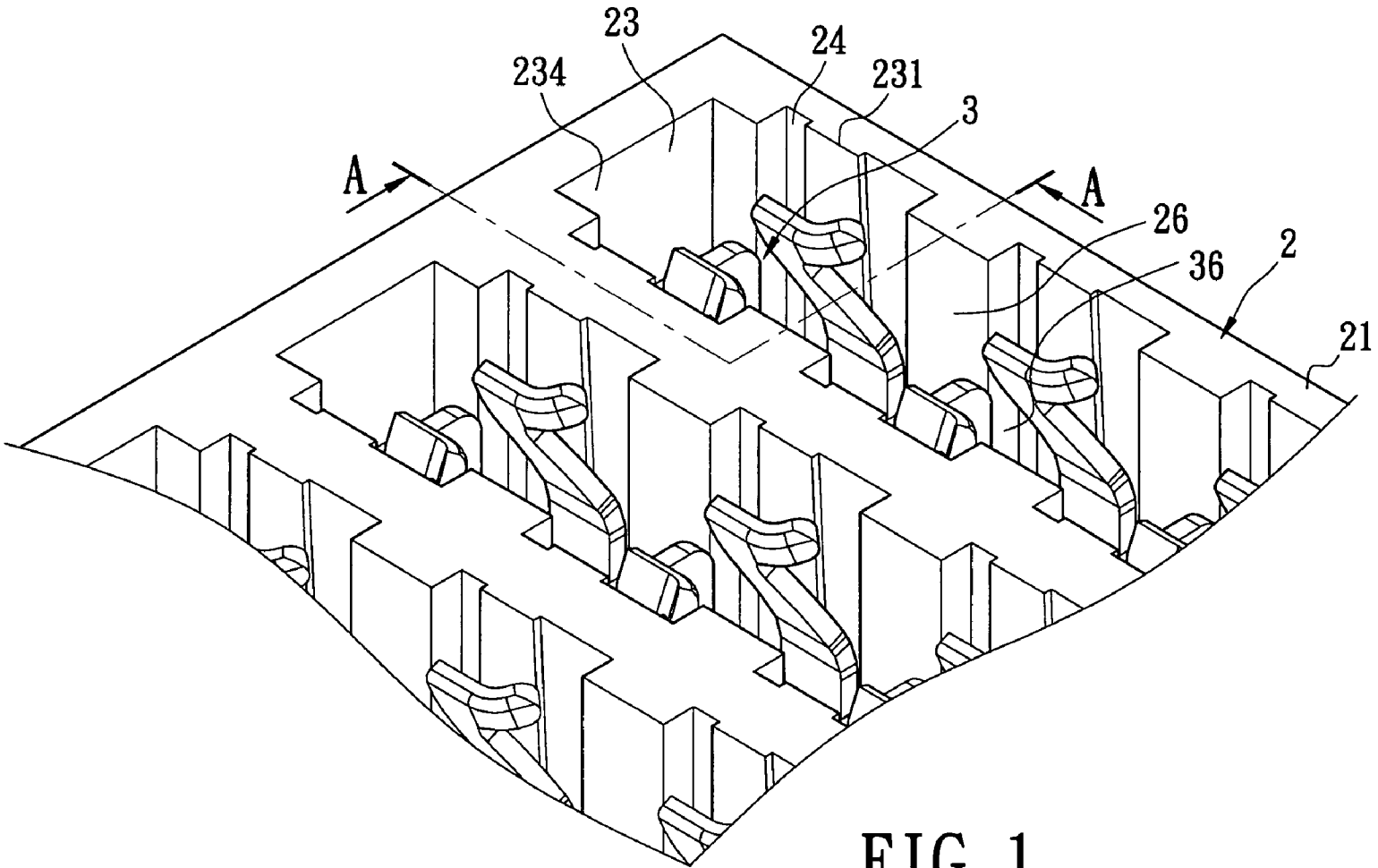
FIG. 1 is a partial and schematic view of the assembled electrical connector and the terminal thereof according to the first embodiment of the present invention.
Figure 2:
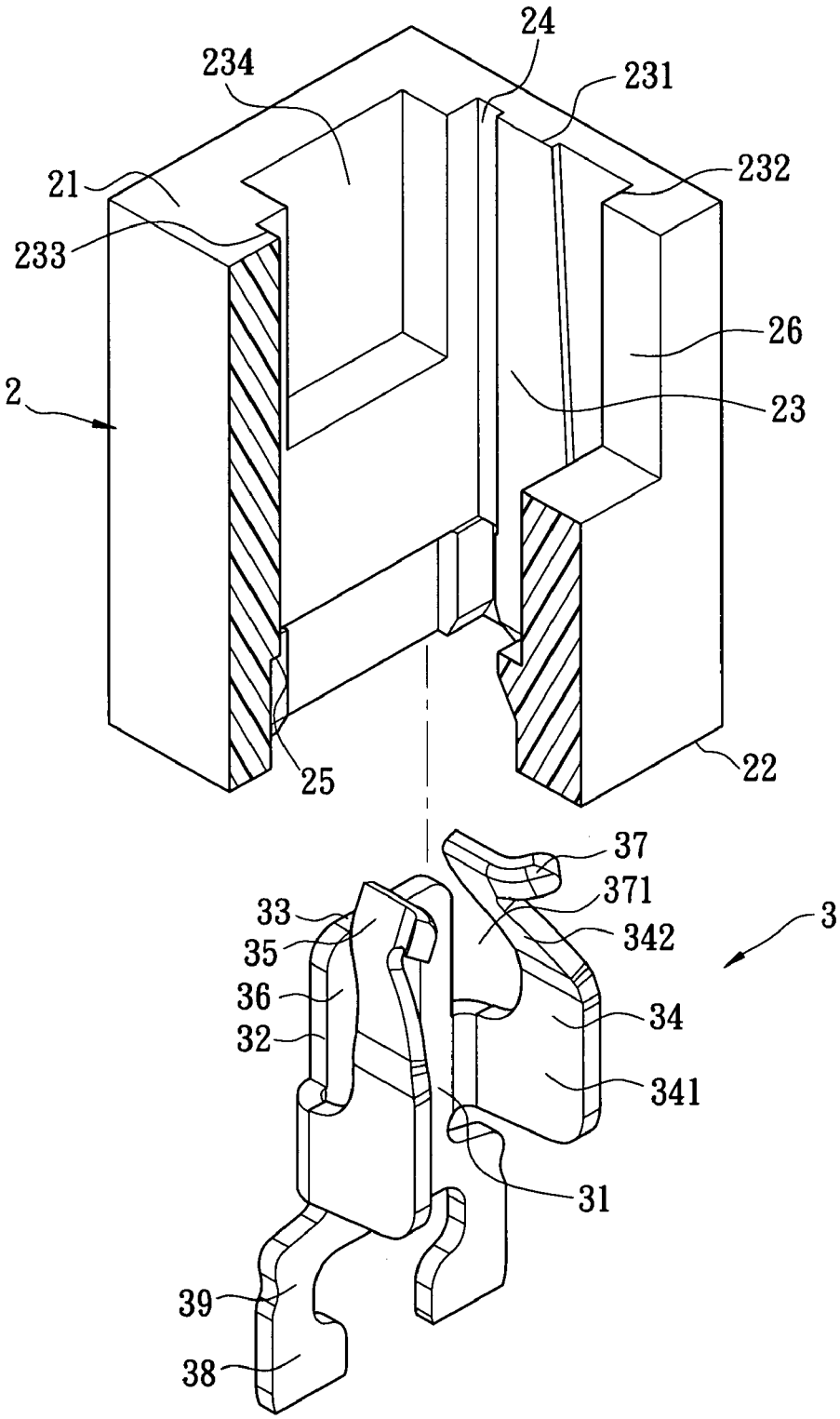
FIG. 2 is a partial and cross-sectional view of the electrical connector and the terminal thereof according to the first embodiment of the present invention.

Reference is made to FIGS. 1 to 6, which is the electrical connector and the terminal thereof according to the first embodiment of the present invention. The electrical connector is used for electrically connecting a chip module (not shown in the figure). The chip module has a plurality of pins 1. The electrical connector includes a main body 2 and a plurality of terminals 3. Because the dimension of the electrical connector is large, part of the electrical connector is shown in the figure to clearly illustrate the content of the present invention.

The main body 2 has an upper surface 21, a lower surface 22 opposite to the upper surface 21, and a plurality of receiving holes 23 that pass through the upper surface 21 and the lower surface 22. The receiving holes 23 are disposed at matrix and intervals.

Each receiving hole 23 has a first side wall 231, a second side wall 232, a third side wall 233 and a fourth side wall 234. The first side wall 231 and the third side wall 233 are opposite to each other. The second side wall 232 and the fourth side wall 234 are opposite to each other and are respectively adjacent to the first side wall 231 and the third side wall 233. The first side wall 231 and the third side wall 233 respectively have a positioning slot 24 for securing the terminals 3 in the receiving hole 23. The lower side of the positioning slot 24 has a blocking portion 25 for blocking the terminals 3 from moving upwards. The upper side of the fourth side wall 234 has a displacement space 26. The displacement space 26 links two adjacent receiving holes 23 and passes through the upper surface 21 of the main body 2.

Each of the terminals 3 is received in the corresponding receiving holes 23.

Figure 3:
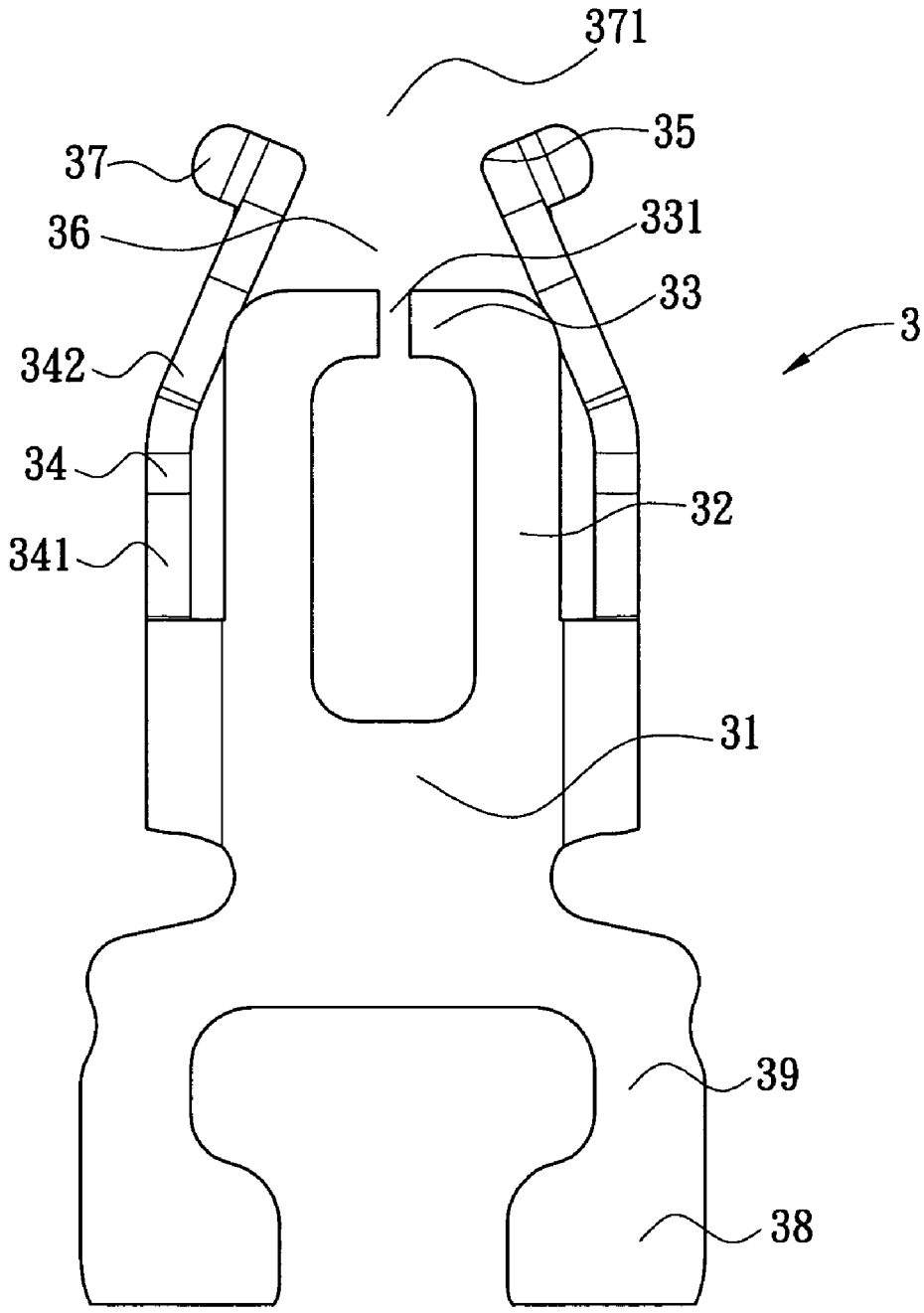
FIG. 3 is a rear view of the terminal according to the first embodiment of the present invention.
Figure 4:
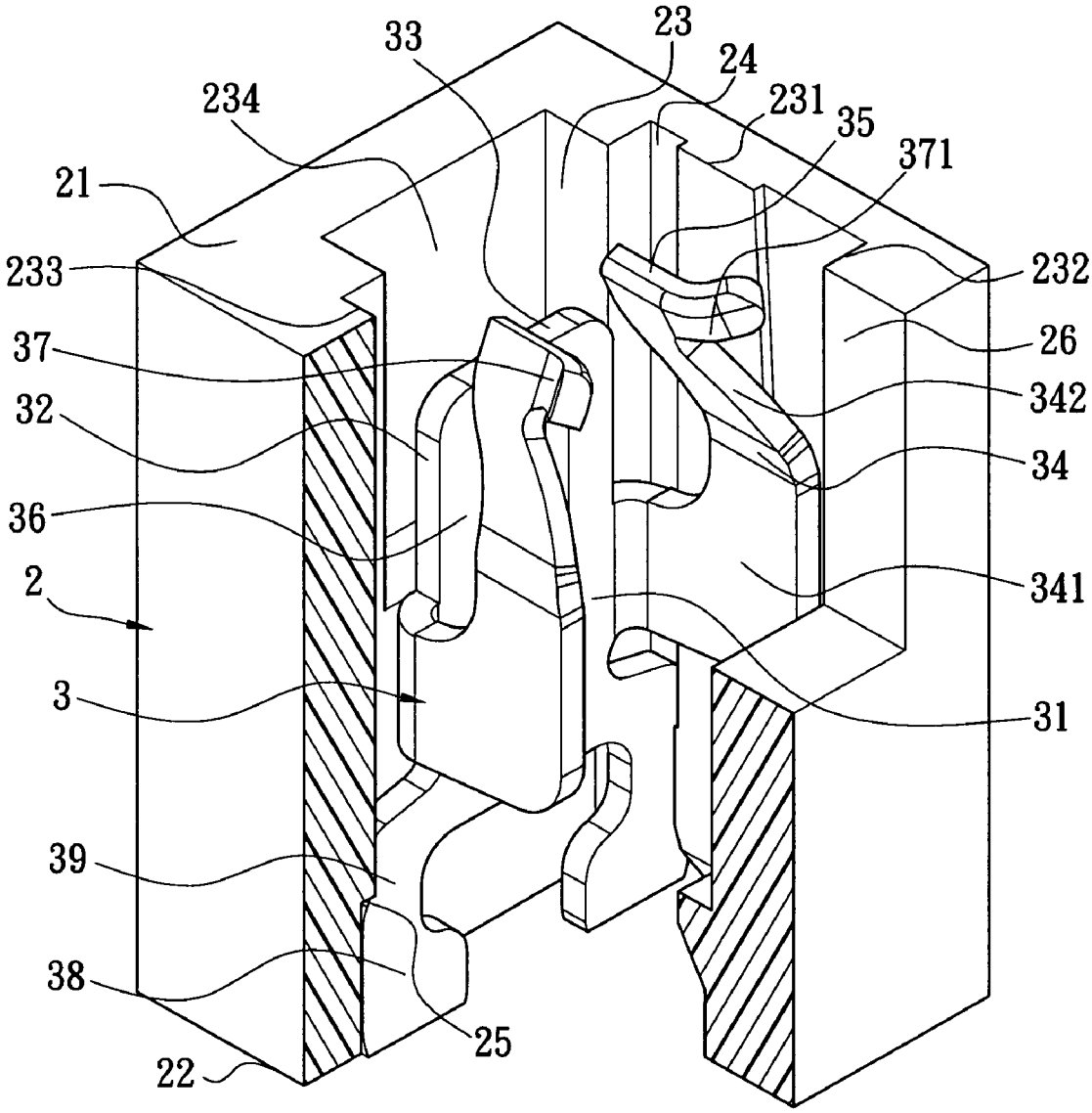
FIG. 4 is an assembly perspective view of FIG. 2.
Figure 5:
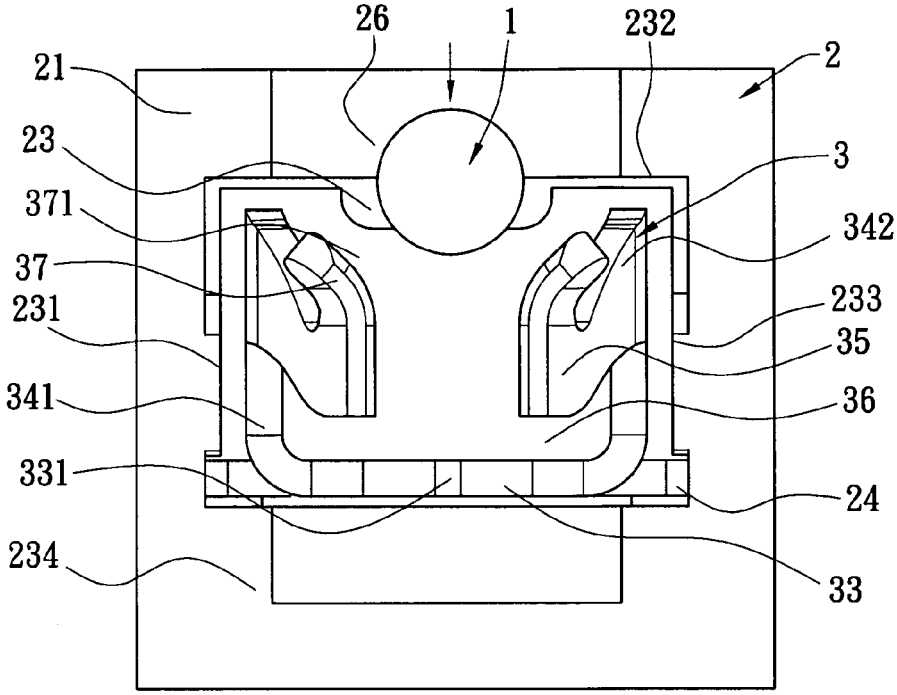
FIG. 5 is a top view of part of the electrical connector and the terminal thereof according to the first embodiment of the present invention that does not contact the pin of the chip module.
Figure 6:
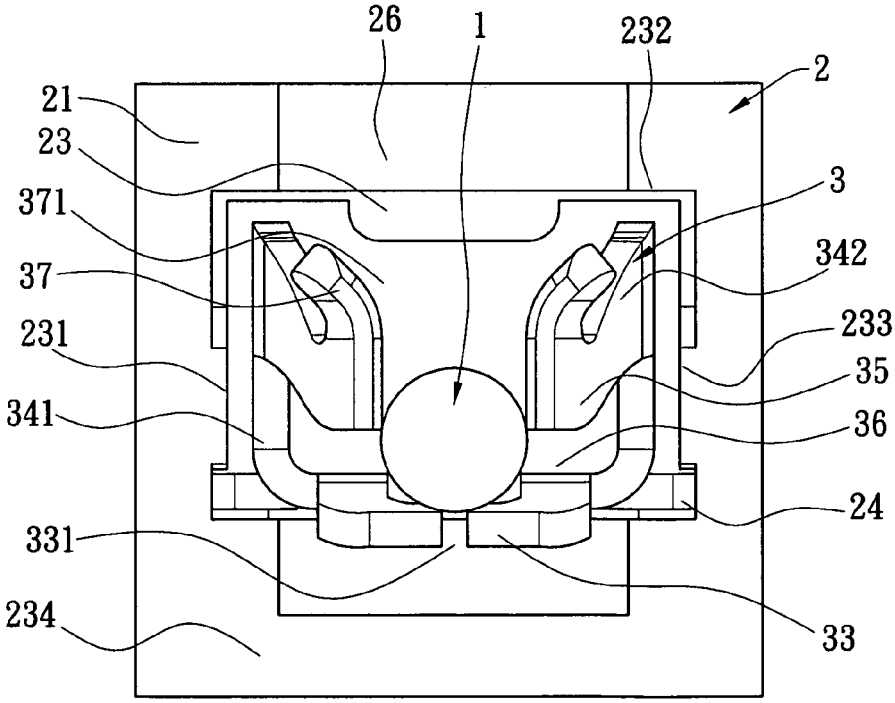
FIG. 6 is a top view of part of the electrical connector and the terminal thereof according to the first embodiment of the present invention that contacts the pin of the chip module.

Reference is made to FIG. 3. The terminal 3 has a base portion 31. The base portion 31 is secured in the positioning slot 24.

The base portion 31 extends upwards to form two flexible arms 32. The two flexible arms 32 are located in the receiving hole 23 and are vertically located on the base portion 31. The two flexible arms 32 are symmetrically disposed. The distance between the two flexible arms 32 is larger than the diameter of the pin 1.

The two flexible arms 32 extend towards each other to form a leaning portion 33. The two leaning portions 33 are horizontally located at end of the flexible arms 32. Alternatively, the two leaning portions 33 also can be located at any location of the inside of the flexible arms 32. The length from the flexible arm 32 linking the leaning portion 33 to the base portion, along with the length of the leaning portion 33 is a force arm that provides the flexible deformation. The two leaning portions 33 also can be curvedly disposed.

There is a gap 331 between the two leaning portions 33. The width of the gap 331 is larger than the diameter of the pin 1 so as to clamp the pin 1 and make the end of the two leaning portions 33 contact the pin 1. Therefore, the force arm that bears the push force from the pin 1 is equal to the leaning portion 33 plus the flexible arm 32. The length between the contact portion of the pin 1 and the two leaning portions 33 and the base portion is the length of the force arm. The leaning portion 33 is used for contacting the pin 1 other than directly contact the two flexible arms 32. The length of the flexible arm 32 pluses the length of the leaning portion 33 make the length of the force arm become longer. In this embodiment, the two leaning portions 33 are located above the base portion 31. In other embodiment, the two leaning portions 33 are located in front of the base portion 31 or behind the base portion 31.

The two sides of the base portion 31 extend forwards and upwards to form two opposite arm portions 34. The two arm portions 34 are located in the receiving hole 23. The two arm portions 34 respectively have a contact portion 35. The two contact portions 35 are located in front of the base portion 31. The two leaning portions 33 and the two contact portions 35 surround to form a receiving space 36 for receiving the pin 1.

The two contact portions 35 are symmetrically disposed. The two contact portions 35 respectively and symmetrically extend to form a guiding portion 37 that is far away from the two leaning portions 33. The two guiding portions 37 extend departing from each other. A guiding space 371 is formed between the two guiding portions 37. The minimum width of the guiding space 371 is larger than the distance between the two contact portions 35 for easily plugging the pins 1.

The two arm portions 34 respectively have a flexible portion 341 and a first connection portion 342. The flexible portion 341 extends forwards from the base portion 31. The first connection portion 342 connects the flexible portion 341 and the contact portion 35. The contact portion 35 extends from the first connection portion 342.

The two flexible portions 341 are symmetrically disposed, so do the two first connection portions 342. The two flexible portions 341 are located in parallel. The two first connection portions 342 are closer to each other during the extending process.

The base portion 31 extends downwards to form a welding portion 38. Two sides of the welding portion 38 respectively have a positioning portion 39 that is fastened with the positioning slot 24 and is blocked by the blocking portion 25.

While assembling, the terminals 3 are installed into the receiving holes 23 from the lower surface 22 to the upper surface 21 until the two flexible arms 32 enter into the receiving holes 23 along the positioning slot 24. The two flexible arms 32 are located at one side of the displacement space 26. The two positioning portions 39 are fastened in the positioning slots 24 and are blocked by the blocking portions 25 to restrict the terminal 3 from moving upwards. Therefore, the terminal 3 will not move upwards nor downwards in the receiving hole 23. The pin 1 will electrically contact the two leaning portions 33 and the two contact portions 35 well.

Next, the chip module (not shown in the figure) is installed into the main body 2. The pin 1 of the chip module (not shown in the figure) enters into the displacement space 26, and is guided into the two contact portions 35 by the two guiding portions 37 and is pushed into the receiving space 36. At this time, the pin 1 contacts the contact portion 35 and pushes the two leaning portions 33 so that the pin 1 is clamped steadily by four points and is in stable status.

When the chip module (not shown in the figure) is installed and the pin 1 pushes the two leaning portions 33, the pin 1 contacts the ends of the two leaning portions 33 and the two leaning portions 33 are located at ends of the two flexible arms and face to each other. The pin 1 does not directly contact the two flexible arms 32. The force arm that provides the flexible deformation is equal to the flexible arm 32 plus the leaning portion 33. The flexibility of the two force arms becomes larger. The deformation of the two force arms also is larger. The anti-push force of the two force arms also increases. The pin 1 will not be deformed. The two force arms will be recovered. The usage life of the terminal 3 is improved. When the pin 1 of the chip module is fully plugged into the main body 2, the contact point of the pin 1 and the terminal 3 is located at the end of the two leaning portions 33. It is far away from the base portion 31. The stress generated by the pin 1 to the two leaning portions 33 is also far away from the base portion 31. The displacement of the pin 1 pushing the two leaning portions 33 increases. Even though there is tolerance between the chip module and the electrical connector, each of the terminals 3 is contacted. The pin 1 electrically conducts the terminal 3 well. Therefore, the chip module electrically connects the electrical connector normally.

Figure 7:
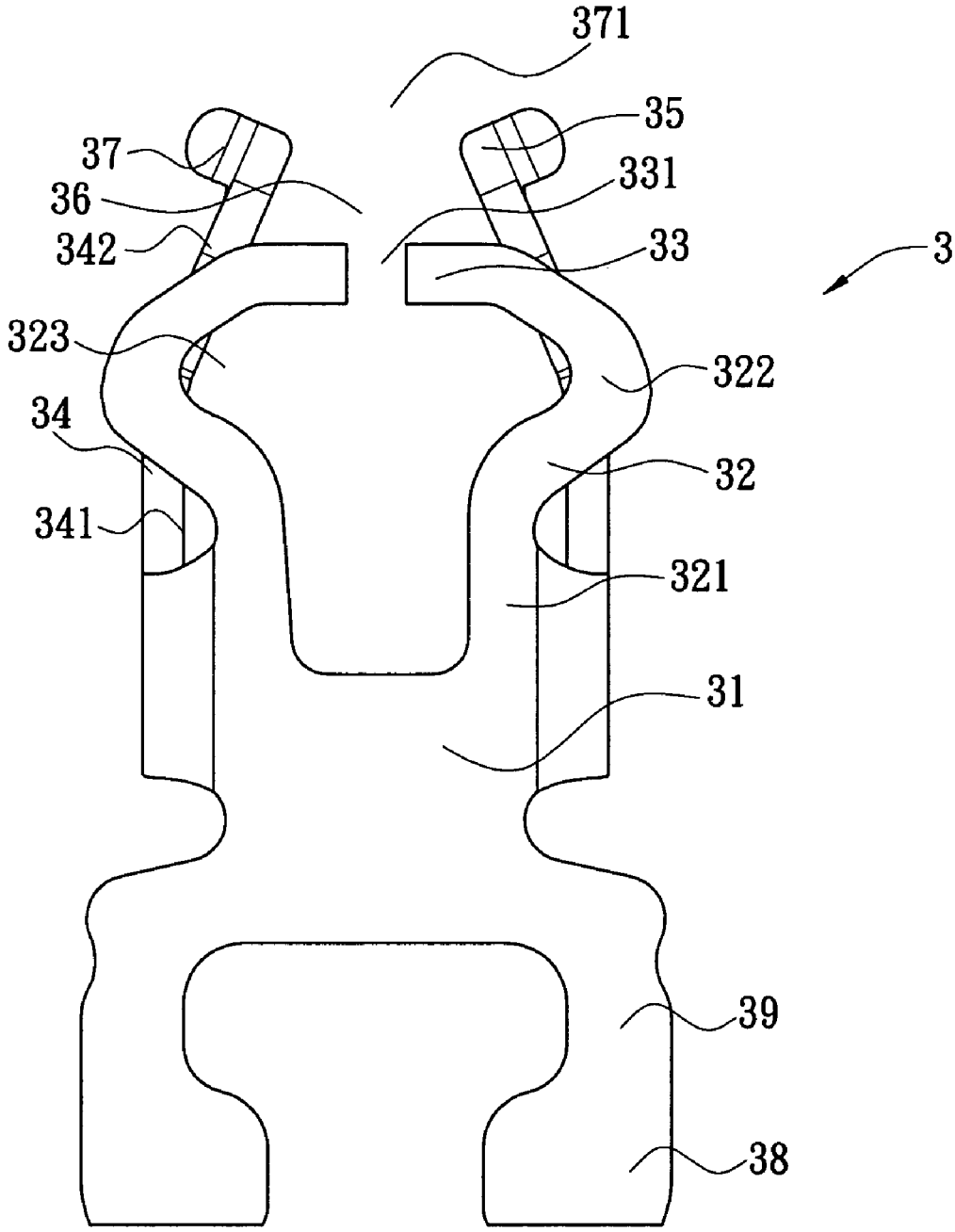
FIG. 7 is a rear view of the terminal according to the second embodiment of the present invention.

Reference is made to FIG. 7, which shows the second embodiment of the electrical connector and the terminal thereof according to the present invention. The difference between the second embodiment and the first embodiment is that:

The two flexible arms 32 are curvedly located on the base portion 31. Two ends of the flexible arm 31 respectively have a second connection portion 321 and a leaning portion 33. The second connection portion 321 is connected with the base portion 31. There is at least one bend portion 322 between the second connection portion 321 and the leaning portion 33.

The bend portion 322 and the leaning portion 33 are located at the different sides of the vertical line of the second connection portion 321. There is an accommodating space 323 between the vertical line of the bend portion 322 and the second connection portion 321. The two accommodating spaces 323 are located at outside of the vertical line of the two second connection portions 321. The two second connection portions 321 are located between the two bend portions 322. The two leaning portions 33 are located between the two second connection portions 321. Alternatively, in other embodiments, the bend portion 322 and the leaning portion 33 are located at the same side of the vertical line of the second connection portion 321. The effect of the second embodiment is the same as the effect of the first embodiment, not repeated again.

The electrical connector and a terminal thereof of the present invention has the following characteristics.

1. Because the pin contacts the ends of the two leaning portions and the two leaning portions are located at ends of the two flexible arms faces to each other, the pin does not directly contact the two flexible arms. The force arm that provides the flexible deformation is equal to the flexible arm plus the leaning portion. The flexibility of the two force arms becomes larger. The deformation of the two force arms also is larger. The anti-push force of the two force arms also increases. The pin will not be deformed due to being bumped. The two force arms will be recovered. The usage life of the terminal 3 is improved.

2. When the pin of the chip module is fully plugged into the main body, the contact point between the pin of chip module and the terminal of the electrical connector is located at end of the two leaning portions. It is far away from the base portion. The stress generated by the pin to the two leaning portions is also far away from the base portion. The displacement of the pin pushing the two leaning portions increases. Even though there is tolerance between the chip module and the electrical connector, each of the pins is contacted. The pin of the chip module electrically conducts the terminal of the electrical connector well. Therefore, the chip module electrically connects the electrical connector normally.

3. Because there is an accommodating space between the vertical line of the bend portion and the second connection portion and the two accommodating spaces are located at outside of the vertical line of the two second connection portions, providing accommodation when the pin of the chip module pushes the leaning portion. It can prevent the stress from being transmitted to the flexible arms due to contacting the flexible arm, in order not to cause the force arm become shorter. The flexibility of the flexible arm is assured. Due to the accommodating space, the length of the force arm becomes longer and its flexibility is improved. The pin of the chip module tightly contact and electrically connect the terminal of the electrical connector.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. An electrical connector, comprising:

a main body having a plurality of receiving holes;

a plurality of terminals correspondingly received in the receiving holes, wherein each of the terminals has a base portion and the base portion is positioned in the receiving hole; and wherein two sides of the base portion extends upwards to form two arm portions, the two arm portions are located in the receiving hole, and the two arm portions respectively have a contact portion;

wherein the base portion extends upwards to form two flexible arms, the two flexible arms are located in the receiving hole, the two flexible arms extend towards each other to form a leaning portion, there is a gap between the two leaning portions, the two contact portions and the two leaning portions are disposed at a front location and a rear location, and the two leaning portions and the two contact portions surround to form a receiving space.

2. The electrical connector as claimed in claim 1, wherein the two flexible arms are symmetrically disposed.

3. The electrical connector as claimed in claim 1, wherein the flexible arm is vertically located on the base portion.

4. The electrical connector as claimed in claim 1, wherein the leaning portion is defined at end of the flexible arm.

5. The electrical connector as claimed in claim 1, wherein the flexible arm is curvedly located on the base portion.

6. The electrical connector as claimed in claim 1, wherein two ends of the flexible arm respectively have a connection portion and one said leaning portion, the connection portion is connected with the base portion, and there is at least one bend portion between the connection portion and the leaning portion.

7. The electrical connector as claimed in claim 6, wherein the bend portion and the leaning portion are respectively located at two sides of a vertical line of the connection portion.

8. The electrical connector as claimed in claim 7, wherein there is an accommodating space defined between the vertical line of the bend portion and the connection portion, and the two accommodating spaces are located at outside of the vertical line of the two connection portions.

9. The electrical connector as claimed in claim 6, wherein the two connection portions are located between the two bend portions.

10. The electrical connector as claimed in claim 6, wherein the two leaning portions are located between the two connection portions.

11. The electrical connector as claimed in claim 1, wherein the two contact portions respectively and symmetrically extend to form a guiding portion along a direction that is far away from the two leaning portions, the two guiding portions extends towards a direction that is far away from each other, and a guiding space is formed between the two guiding portions.

12. A terminal, comprising:

a base portion;

two contact portions located oppositely to each other, and respectively in front of the base portion, wherein the two contact portions respectively extend downwards to from an arm portion connecting with two sides of the base portion; and two leaning portions located oppositely to each other, and respectively behind the two contact portions, wherein one end of the two leaning portions respectively extends downwards to form a flexible arm, the two flexible arms respectively are connected with the base portion, and the two leaning portions and the two contact portions surrounds to form a receiving space.

13. The terminal as claimed in claim 12 wherein the two leaning portions are located above the base portion.

14. The terminal as claimed in claim 12 wherein the two leaning portions are located in front of the base portion.

15. The terminal as claimed in claim 12 wherein the two leaning portions are located behind the base portion.

16. The terminal as claimed in claim 12 wherein the two flexible arms are symmetrically disposed.

17. The terminal as claimed in claim 12 wherein the flexible arm is vertically located on the base portion.

18. The terminal as claimed in claim 12 wherein the flexible arm is curvedly located on the base portion.

* * * * *